US009409627B2

(12) United States Patent
Fulop et al.

(10) Patent No.: US 9,409,627 B2
(45) Date of Patent: Aug. 9, 2016

(54) COLLAPSIBLE WATERCRAFT ASSEMBLY

(71) Applicants: Joseph Webb Fulop, Mission (CA); Anthony Fulop, Creston (CA)

(72) Inventors: Joseph Webb Fulop, Mission (CA); Anthony Fulop, Creston (CA)

( * ) Notice: Subject to any disclaimer, the term of this patent is extended or adjusted under 35 U.S.C. 154(b) by 0 days.

(21) Appl. No.: 14/817,230

(22) Filed: Aug. 4, 2015

(65) Prior Publication Data

US 2016/0039498 A1 Feb. 11, 2016

Related U.S. Application Data

(60) Provisional application No. 62/035,835, filed on Aug. 11, 2014.

(51) Int. Cl.
*B63B 7/02* (2006.01)
*B63B 1/12* (2006.01)

(52) U.S. Cl.
CPC ..... *B63B 7/02* (2013.01); *B63B 2001/123* (2013.01); *B63B 2241/26* (2013.01)

(58) Field of Classification Search
CPC ..... B63B 7/00; B63B 7/02; B63B 7/04; B63B 1/00; B63B 1/12; B63B 1/121
USPC ..... 114/61.22, 352, 353, 354
See application file for complete search history.

(56) References Cited

U.S. PATENT DOCUMENTS 3,883,909 A * 5/1975 Fisher ..... B63B 7/04 114/352
4,828,517 A 5/1989 Van Liefland
4,919,632 A * 4/1990 Smith ..... B63B 1/121 114/352
5,074,233 A 12/1991 Weed
5,086,721 A 2/1992 Burkard
5,088,944 A 2/1992 Kats
5,374,206 A 12/1994 Gregory
5,619,943 A 4/1997 Kieronski
5,651,706 A 7/1997 Kasper
5,692,450 A 12/1997 Alter et al.
6,311,632 B1 11/2001 Noel, Jr.
6,345,582 B1 2/2002 Dudink
6,508,194 B2 1/2003 Myers
6,988,456 B1 1/2006 Schooler
7,096,817 B1 8/2006 Scadden
7,354,326 B2 4/2008 Lukens
7,461,607 B2 12/2008 Reilly et al.
7,587,986 B2 9/2009 Neidert et al.
8,656,856 B1 2/2014 Morrow
(Continued)

FOREIGN PATENT DOCUMENTS

DE 4341781 A1 6/1995
WO 03016131 A1 2/2003

*Primary Examiner* — Lars A Olson

(57) ABSTRACT

A collapsible watercraft assembly can include a first pontoon half, a second pontoon half, and a frame member. Each pontoon half can have a top surface, a bottom surface, and at least one post. The first pontoon half and the second pontoon half can be positionable with respect to one another in an operating configuration and a stowed configuration. The operating configuration can be defined when the sterns of the pontoon halves confront one another and the stowed configuration can be defined when the top surfaces of the pontoon halves confront one another. The frame member can be concurrently engageable with the posts to fix the pontoon halves together in the operating configuration. The posts can be interconnected with one another when the first pontoon half and the second pontoon half are in the stowed configuration.

20 Claims, 6 Drawing Sheets

(56) References Cited

U.S. PATENT DOCUMENTS

| | | | |
|---|---|---|---|
| 2001/0032574 | A1 | 10/2001 | Newton et al. |
| 2002/0129756 | A1 | 9/2002 | Myers |
| 2006/0191454 | A1 | 8/2006 | Scadden |
| 2006/0205297 | A1 | 9/2006 | Carter et al. |
| 2009/0183664 | A1 | 7/2009 | White, Jr. |

* cited by examiner

COLLAPSIBLE WATERCRAFT ASSEMBLY

CROSS-REFERENCE TO RELATED APPLICATIONS

This application claims the benefit of U.S. Provisional Patent Application Ser. No. 62/035,835 for a PONTOON ELEMENT-BASED WATERCRAFT APPARATUS, filed on Aug. 11, 2014, which is hereby incorporated by reference in its entirety.

BACKGROUND

1. Field

The present disclosure relates to a collapsible watercraft.

2. Description of Related Prior Art

U.S. Pat. No. 6,508,194 discloses a PONTOON WATERCRAFT. The pontoon watercraft has a pair of pontoons with twin bladders secured by a three piece yoke frame which maintain the pontoons spaced apart and symmetrical and parallel with each other to accommodate the user, with an integrated load leveling system for personal and operational convenience. The watercraft is adapted to support an adjustable motor and anchor mount behind the user and two piece oars in gunwales at the outermost part of the yoke frame. The design provides for other auxiliary items such as a mesh fish basket, storage containers and the like. Further, the watercraft is assembled with no special tools and when disassembled the entire watercraft can be stored in a suitable bag having a length of approximately four feet and a girth of approximately six to seven feet. In addition, two pontoon watercrafts are coupled in tandem with the fore ends of the pontoons of one watercraft nestled with the aft ends of the pontoons of another watercraft with a lattice work coupling the frame of the two watercrafts, which form a composite watercraft. The watercrafts are adapted to support stand-up apparatus.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A collapsible watercraft assembly can include a first pontoon half, a second pontoon half, and a frame member. The first pontoon half can have a first top surface, a first bottom surface opposite the first top surface, and at least one first post. The at least one first post can extend between a first base end and a first distal end with the first base end positioned closer to the first bottom surface than the first distal end. The first pontoon half can extend longitudinally between a first stern and a first bow. The second pontoon half can have a second top surface, a second bottom surface opposite the second top surface, and at least one second post. The second post can extend between a second base end and a second distal end with the second base end positioned closer to the second bottom surface than the second distal end. The second pontoon half can extend longitudinally between a second stern and a second bow. The first pontoon half and the second pontoon half can be positionable with respect to one another in an operating configuration and a stowed configuration. The operating configuration can be defined when the first stern and the second stern confront one another and the stowed configuration can be defined when the first top surface and the second top surface confront one another. The frame member can be selectively engageable and disengageble with both of the first pontoon half and the second pontoon half. The frame member can be concurrently engageable with the at least one first post and the at least one second post to fix the first pontoon half and the second pontoon half together in the operating configuration. The frame member can be disengageable with the at least one first post and the at least one second post to collapse the first pontoon half from the second pontoon half. The at least one first post and the at least one second post can be selectively engageable and disengageble with one another. The at least one first post and the at least one second post can be spaced from one another when the first pontoon half and the second pontoon half are in the operating configuration. The at least one first post and the at least one second post can be interconnected with one another when the first pontoon half and the second pontoon half are in the stowed configuration.

BRIEF DESCRIPTION OF THE DRAWINGS

The detailed description set forth below references the following drawings.

DETAILED DESCRIPTION

Figure 1:
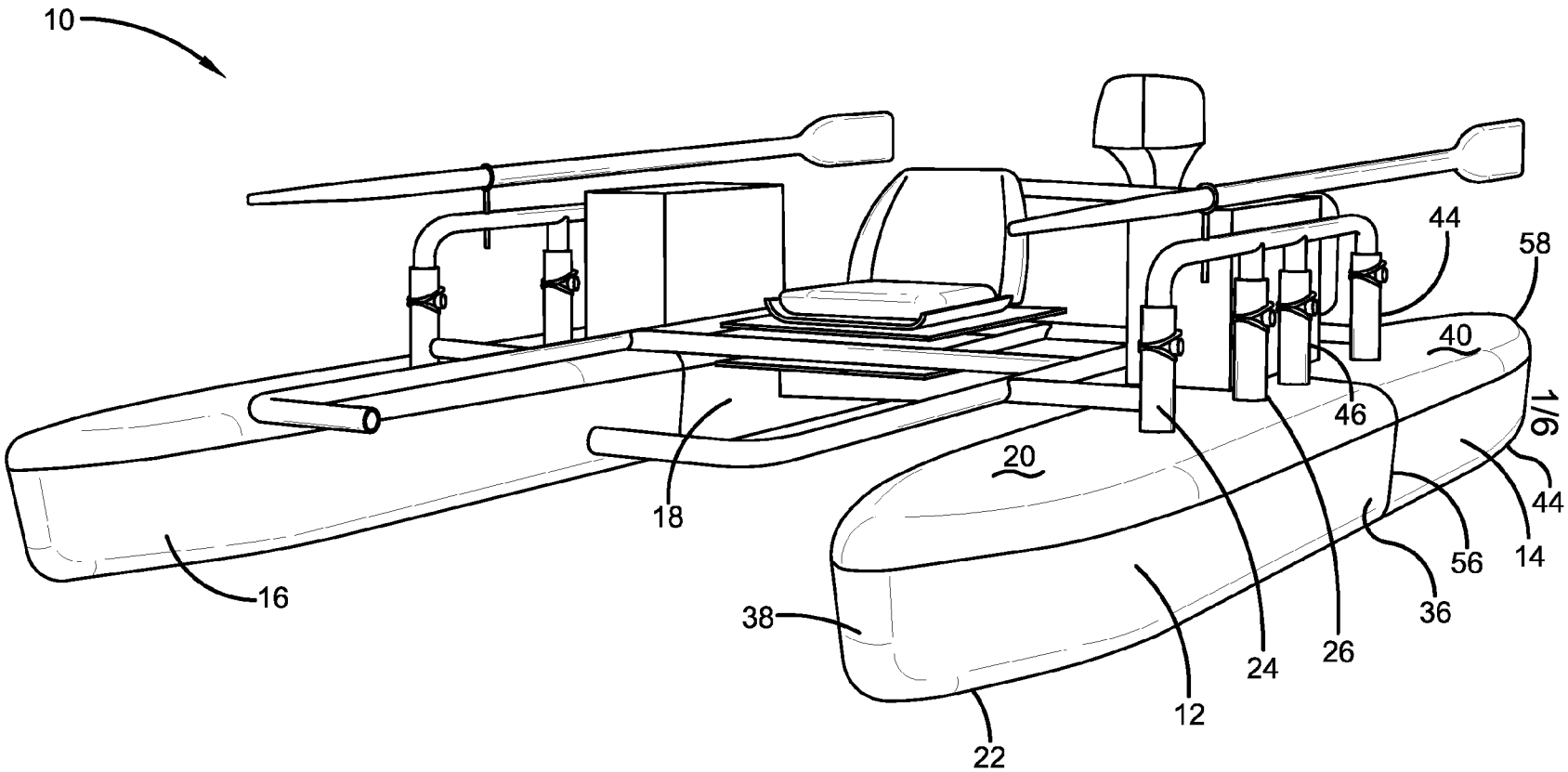
FIG. 1 is a collapsible watercraft assembly in an operating configuration according to an exemplary embodiment of the present disclosure.
Figure 3:
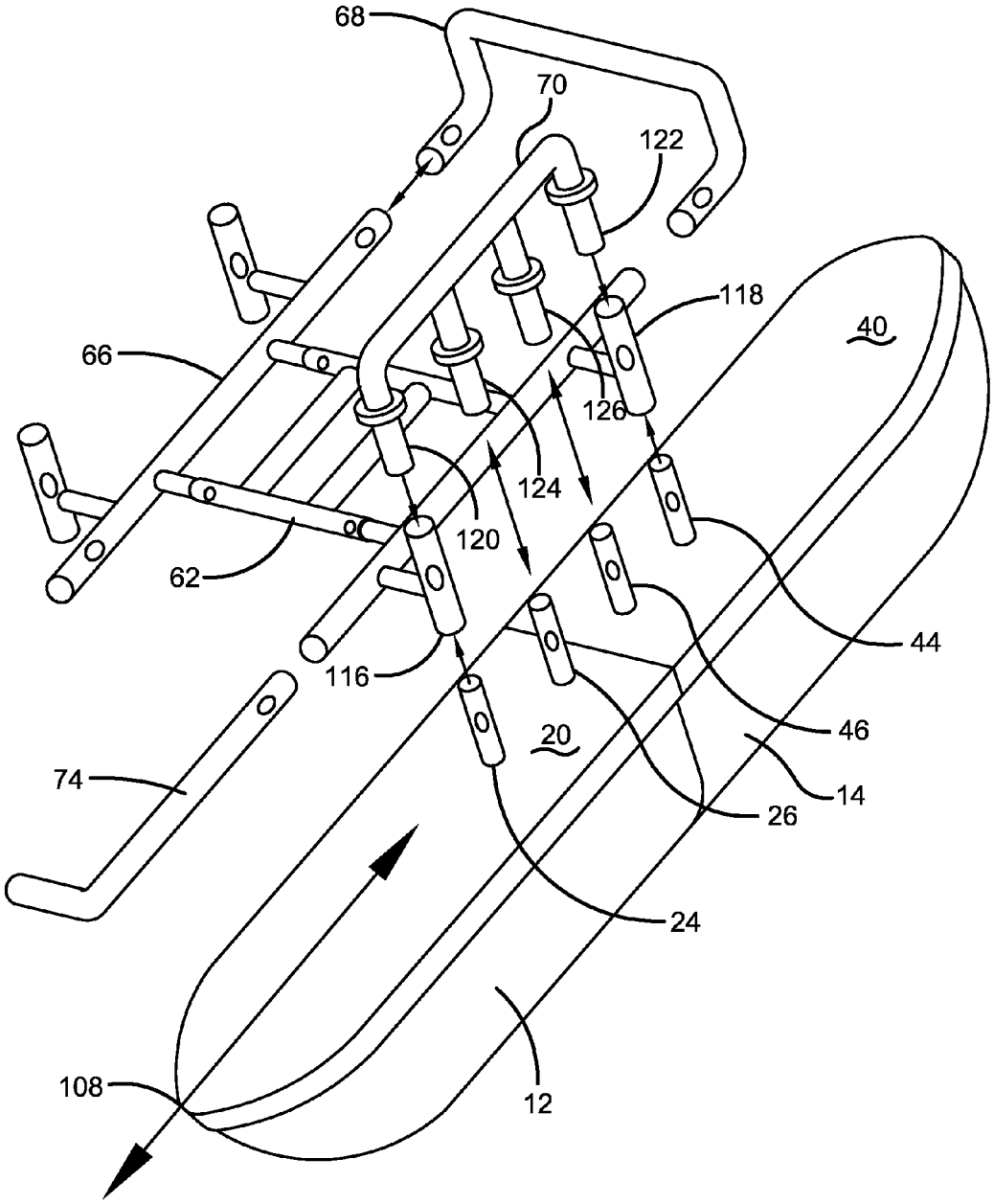
FIG. 3 is a perspective view of portions of a collapsible watercraft assembly in exploded form according to an exemplary embodiment of the present disclosure.
Figure 5:
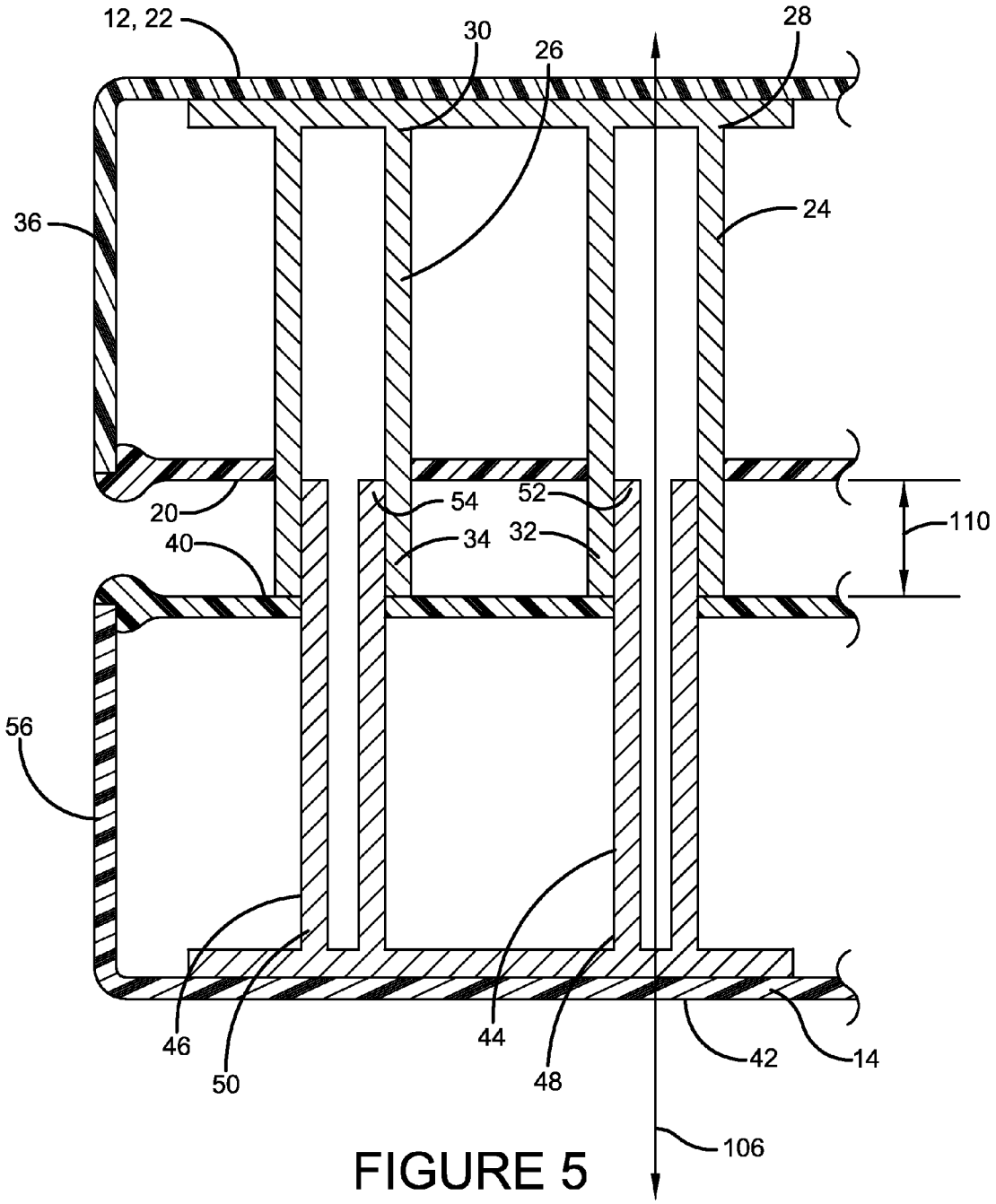
FIG. 5 is a cross-sectional view taken through a portion of a collapsible watercraft assembly in a stowed configuration according to an exemplary embodiment of the present disclosure.

Referring now to FIG. 1, a collapsible watercraft assembly 10 can include a plurality of pontoon halves such as a first pontoon half 12, a second pontoon half 14, a third pontoon half 16, and a fourth pontoon half 18. The first pontoon half 12 and the third pontoon half 16 can be identical or substantially similar to one another. The first pontoon half 12 can have a first top surface 20, a first bottom surface 22 opposite the first top surface 20, and at least one first post. The exemplary first pontoon half 12 can include first posts 24 and 26. In the exemplary embodiment, the posts 24, 26 extend away from the first bottom surface 22 beyond the first top surface 20 and thus extend above the top surface 20. As best shown in FIG. 3, the posts 24, 26 can be aligned along a centered, longitudinal axis 108 of the first pontoon half 12. As best shown in FIG. 5, each of the posts 24, 26 can extend between respective base ends 28, 30 and respective distal ends 32, 34, wherein the base ends 28, 30 can be positioned closer to the first bottom surface 22 than the distal ends 32, 34. Referring again to FIG. 1, the first pontoon half 12 can extend longitudinally between a first stern 36 and a first bow 38.

The second pontoon half 12 and the fourth pontoon half 18 can be identical or substantially similar to one another. The second pontoon half 14 can have a second top surface 40, a second bottom surface 42 opposite the second top surface 40, and at least one second post. The exemplary second pontoon half 14 can include second posts 44 and 46. As best shown in FIG. 5, each of the posts 44, 46 can extend between respective base ends 48, 50 and respective distal ends 52, 54, wherein the base ends 48, 50 can be positioned closer to the second bottom surface 42 than the distal ends 52, 54. Referring again to FIG. 1, the second pontoon half 14 can extend longitudinally between a second stern 56 and a second bow 58.

Figure 4:
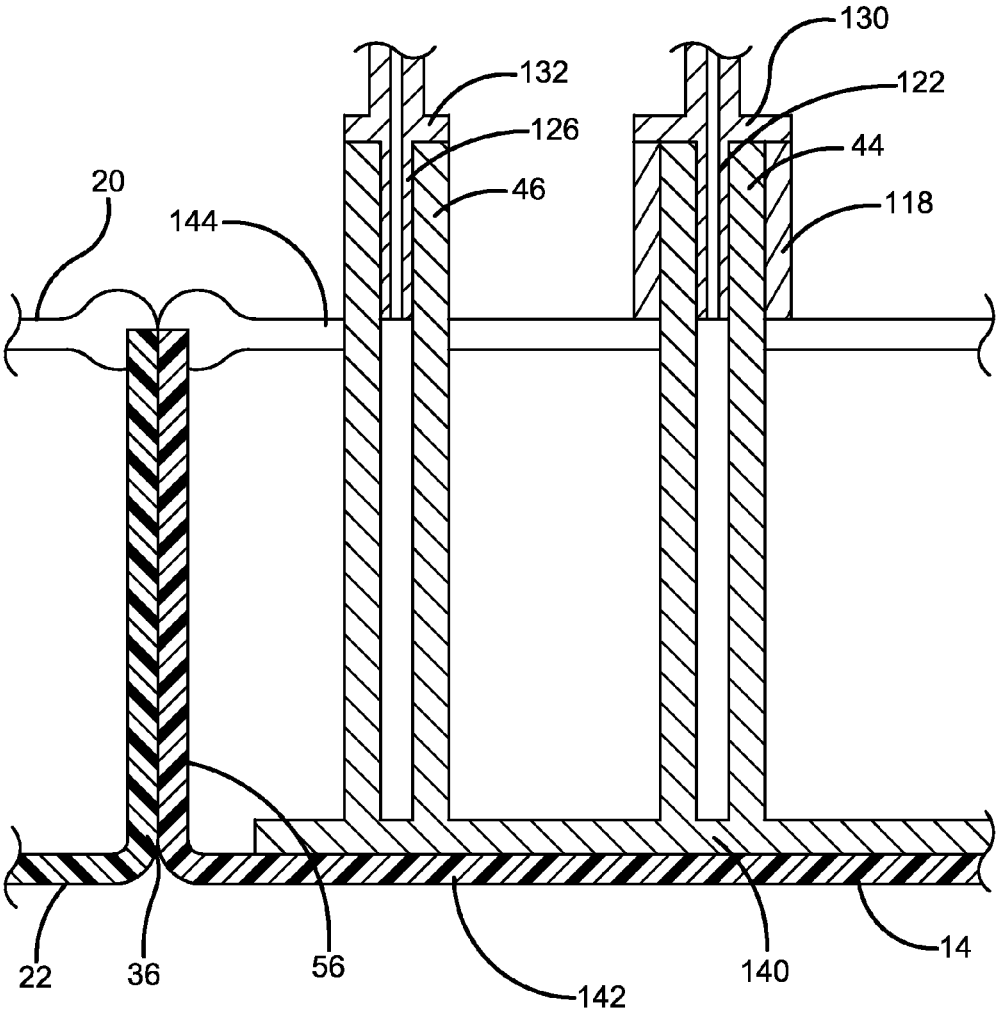
FIG. 4 is a cross-sectional view taken through a portion of a collapsible watercraft assembly in an operating configuration according to an exemplary embodiment of the present disclosure.
Figure 6:
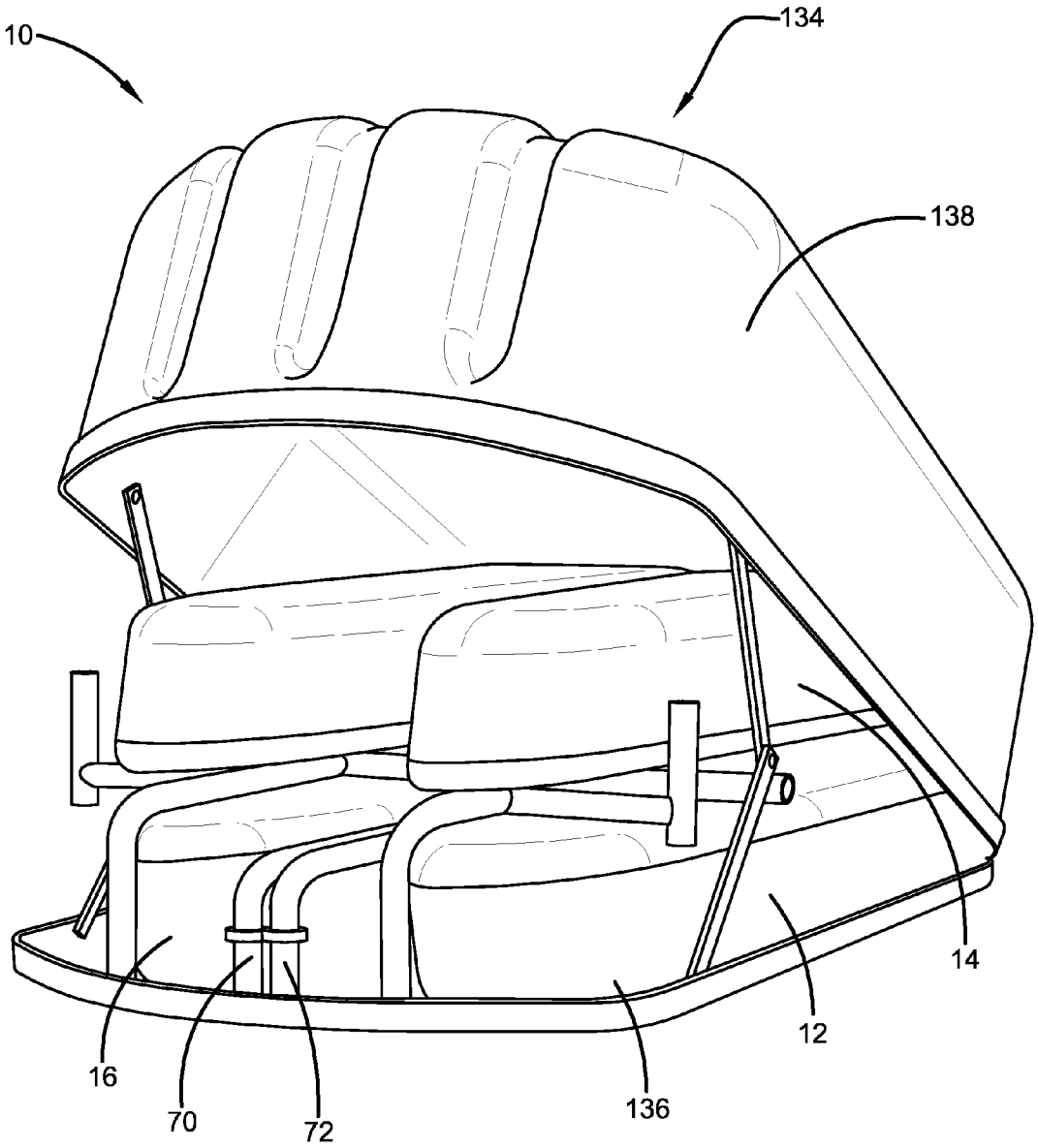
FIG. 6 is a collapsible watercraft assembly in a stowed configuration according to an exemplary embodiment of the present disclosure.

The first pontoon half 12 and the second pontoon half 14 can be positionable with respect to one another in an operating configuration and a stowed configuration. FIG. 1 shows the exemplary embodiment in the operating configuration. The operating configuration can be defined when the first stern 36 and the second stern 56 confront one another. FIG. 4 shows the sterns 36, 56 confronting one another in the operating configuration. FIG. 6 shows the exemplary embodiment in the stowed configuration. The stowed configuration can be defined when the first top surface 20 and the second top surface 40 confront one another. FIG. 5 shows the top surfaces 20, 40 confronting one another in the stowed configuration.

Referring now to FIG. 4, the posts 44, 46 can extend from a plate 140. The plate 140 can be embedded in the pontoon half 14. The pontoon half 14 can have a plastic body 142 and enclosed by a plastic cap 144. The plate 140, with posts 44, 46 can be placed in the plastic body 142. After placement of the plate 140, the interior of the plastic body 142 can be filled with settable foam or some other material enhancing the buoyancy of the assembly 10. After filling the body 142 with foam, the cap 144 can be put in place to enclose the body 142.

Figure 2:
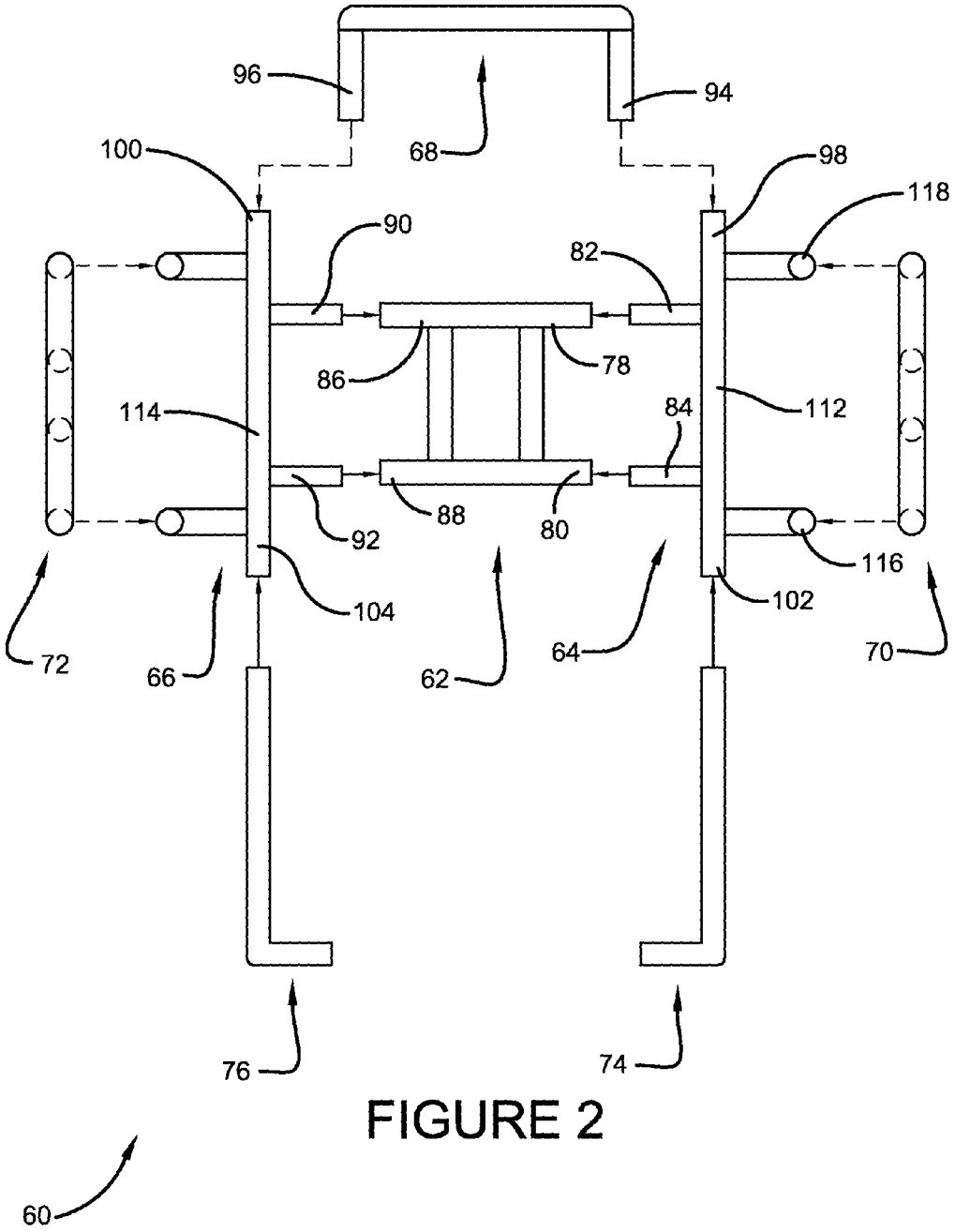
FIG. 2 is an exploded view of a framework of a collapsible watercraft assembly according to an exemplary embodiment of the present disclosure.

Referring now to FIG. 2, a framework 60 can interconnect the pontoon halves 12, 14, 16, 18. The framework 60 can be selectively engageable and disengageble with respect to the pontoon halves 12, 14, 16, 18. Selectively engageable and disengageble refers to the fact that a user of the assembly 10 can attach and detach, connect and disconnect components as desired and repeatedly. The framework 60 can include seat support member 62; first and second frame members 64, 66; luggage support member 68; railing members 70, 72; and foot rest members 74, 76. The frame member 64 and the frame member 66 can be identical or substantially similar to one another. The railing member 70 and the railing member 72 can be identical or substantially similar to one another. The foot rest member 74 and the foot rest member 76 can be identical or substantially similar to one another.

The various components of the framework 60 can be selectively engageable and disengageble with respect to one another. Each component of the framework 60 can include one or more tubular portions of any desired shape that are telescopically engageable with tubular portions of one or more other components of the framework 60. The various tubular portions can include apertures for receiving pins to selectively lock two telescopically engaged tubular portions.

Tubular portions 78, 80 of the seat support member 62 can telescopically engage tubular portions 82, 84 of the frame member 64. Tubular portions 86, 88 of the seat support member 62 can telescopically engage tubular portions 90, 92 of the frame member 66. Tubular portions 94, 96 of the luggage support member 68 can telescopically engage a tubular portion 98 of the frame member 64 and a tubular portion 100 of the frame member 66. The foot rest member 74 can be telescopically engaged with a tubular portion 102 of a linking portion 112 of the frame member 64. The foot rest member 76 can be telescopically engaged with a tubular portion 104 of linking portion 114 of the frame member 66.

The frame member 64 and the frame member 66 can be identical or substantially similar to one another. The frame member 64 can be a single, integral structure or a plurality of structures connected together. The frame member 64 can be selectively engageable and disengageble with both of the first pontoon half 12 and the second pontoon half 14. The frame member 64 can be concurrently engageable with the at least one first post 24 and the at least one second post 44 to fix the first pontoon half 12 and the second pontoon half 14 together in the operating configuration. The frame member 64 can be disengageable with the at least one first post 24 and the at least one second post 44 to collapse the first pontoon half 12 from the second pontoon half 14.

The first post 24 and the second post 44 can have a cross-section of any desired shape, such as, by way of example and not limitation, round, rectangular, oval or asymmetric. The first post 24 and the post 26 can be identical or substantially similar to one another. The second post 44 and the post 46 can be identical or substantially similar to one another. The at least one first post 24 and the at least one second post 44 can be selectively engageable and disengageble with one another. The at least one first post 24 and the at least one second post 44 can be spaced from one another when the first pontoon half 12 and the second pontoon half 14 are in the operating configuration. The at least one first post 24 and the at least one second post 44 can be interconnected with one another when the first pontoon half 12 and the second pontoon half 14 are in the stowed configuration.

As best shown in FIG. 5, the at least one first post 24 and the at least one second post 44 can be at least partially telescopically interconnected with one another when the first pontoon half 12 and the second pontoon half 14 are in the stowed configuration. The at least one first post 24 and the at least one second post 44 can guide movement of the first pontoon half 12 and the second pontoon half 14 with respect to one another when the first pontoon half 12 and the second pontoon half 14 are in moved into the stowed configuration. The post 24 can be larger than the post 44 so that the post 44 can slide into the post 24 during movement of the first pontoon half 12 and the second pontoon half 14 into the stowed configuration. The first pontoon half 12 and the second pontoon half 14 can be moved along a first axis 106 when moved into the stowed configuration. The at least one first post 24 and the at least one second post 44 can overlap along the first axis 106 when the first pontoon half 12 and the second pontoon half 14 are in the stowed configuration. The posts 26 and 46 can engage one another as the posts 24, 44 engage one another.

The engagement between the posts 24 and 44 and between the posts 26 and 46 prevent the first top surface 20 and the second top surface 40 from contacting one another when the first pontoon half 12 and the second pontoon half 14 are in the stowed configuration. A vertical gap 110 is thus defined between the first top surface 20 and the second top surface 40 when the first pontoon half 12 and the second pontoon half 14 are in the stowed configuration. The frame members 64 and 66 can fit in the vertical gap 110 between both of the first top surface 20 and the second top surface 40 when the first pontoon half 12 and the second pontoon half 14 are in the stowed configuration, as shown in FIG. 6. The first frame member 64 and the second frame member 66 can be stackable on top of one another in the vertical gap 110 when the first pontoon half 12 and the second pontoon half 14 are in the stowed configuration.

The exemplary frame member 64 can include a first sleeve portion 116 and a second sleeve portion 118. The first sleeve portion 116 can telescopically engaged with the at least one first post 24 when the first pontoon half 12 and the second pontoon half 14 are in the operating configuration. FIG. 4 illustrates the sleeve portion 118 telescopically engaged with the post 44 when the first pontoon half 12 and the second pontoon half 14 are in the operating configuration. The linking portion 112 can interconnect the first sleeve portion 116 and the second sleeve portion 118 in spaced relation to one another.

Referring again to FIG. 3, the railing member 70 can include a plurality of shaft portions, such as a first shaft portion 120, a second shaft portion 122, a third shaft portion 124 and a fourth shaft portion 126. The first shaft portion 120 and the second shaft portion 122 can be identical or substantially similar to one another. The third shaft portion 124 and the fourth shaft portion 126 can be identical or substantially similar to one another. The railing member 70 can also include a railing portion 128 interconnecting the shaft portions 120, 122, 124, 126 in spaced relation to one another.

The first shaft portion 120 is telescopically engageable with the at least one first post 24 when the first pontoon half 12 and the second pontoon half 14 are in the operating configuration. FIG. 4 illustrates the second shaft portion 122 telescopically engaged with the at least one second post 44 when the first pontoon half 12 and the second pontoon half 14 are in the operating configuration. The at least one first post 24 can encircle the first shaft portion 120 and the first sleeve portion 116 can encircle the at least one first post 24 when the first pontoon half 12 and the second pontoon half 14 are in the operating configuration. FIG. 4 illustrates the at least one second post 44 encircling the second shaft portion 122 and the second sleeve portion 118 encircling the at least one second post 44 when the first pontoon half 12 and the second pontoon half 14 are in the operating configuration.

The shaft portion 126 can telescopically engage the post 46 as shown in FIG. 4. The shaft portion 124 can telescopically engage the post 26. Flanges can be positioned on each of the shaft portions 120, 122, 124 and 126 to provide a positive stop, limiting insertion of the shaft portions 120, 122, 124 and 126 in the respective posts 24, 26, 44, 46. Exemplary flanges are referenced at 130 and 132 in FIG. 4.

Referring again to FIG. 6, the components of the assembly 10 can be stored in a case 134 when the assembly 10 is collapsed. The case 134 can have a base 136 and a lid 138 pivotally connected to one another. The first pontoon half 12 and the second pontoon half 14 can be stackable on top of one another in the stowed configuration and positionable in the case 134 while in the stowed configuration. The frame members 64 and 66 can rest on the top surfaces of the pontoon haves 12, 16, in the gap 110. A portion of the luggage support member 68 can be positioned in the gap 110 as well. The seat support member 62 can rest on the frame members 64, 66. The distal ends of the footrest members 74, 76 can be pointed downwardly. A length of the distal ends of the footrest members 74, 76 can be equal to or less than a height the pontoon halves 12, 16, as shown in FIG. 6. This feature allows the footrest members 74, 76 to be easily stowed in the case 134. A height of the railing members 70, 72 can be equal to or less than a height of the pontoon halves 12, 14, as shown in FIG. 6. This feature allows the railing members 70, 72 to be stowed in between the pontoon halves 12 and 16 and below the frame members 64 and 66 in the case.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. Further, the right to claim elements and/or sub-combinations that are disclosed herein as other present disclosures in other patent documents is hereby unconditionally reserved.

What is claimed is:

1. A collapsible watercraft assembly comprising:

a first pontoon half having a first top surface, a first bottom surface opposite said first top surface, and at least one first post extending between a first base end and a first distal end with said first base end positioned closer to said first bottom surface than said first distal end, said first pontoon half extending longitudinally between a first stern and a first bow;

a second pontoon half having a second top surface, a second bottom surface opposite said second top surface, and at least one second post extending between a second base end and a second distal end with said second base end positioned closer to said second bottom surface than said second distal end, said second pontoon half extending longitudinally between a second stern and a second bow;

said first pontoon half and said second pontoon half positionable with respect to one another in an operating configuration and a stowed configuration, said operating configuration defined when said first stern and said second stern confront one another, and said stowed configuration defined when said first top surface and said second top surface confront one another;

a frame member selectively engageable and disengageble with both of said first pontoon half and said second pontoon half, said frame member concurrently engageable with said at least one first post and said at least one second post to fix said first pontoon half and said second pontoon half together in said operating configuration, and said frame member disengageable with said at least one first post and said at least one second post to collapse said first pontoon half from said second pontoon half; and wherein said at least one first post and said at least one second post are selectively engageable and disengageble with one another, said at least one first post and said at least one second post are spaced from one another when said first pontoon half and said second pontoon half are in said operating configuration, and said at least one first post and said at least one second post are interconnected with one another when said first pontoon half and said second pontoon half are in said stowed configuration.

2. The collapsible watercraft assembly of claim 1 wherein said at least one first post and said at least one second post are at least partially telescopically interconnected with one another when said first pontoon half and said second pontoon half are in said stowed configuration.

3. The collapsible watercraft assembly of claim 1 wherein said at least one first post and said at least one second post guide movement of said first pontoon half and said second pontoon half with respect to one another when said first pontoon half and said second pontoon half are in moved into said stowed configuration.

4. The collapsible watercraft assembly of claim 1 wherein said at least one first post and said at least one second post are at least one of differently-sized or differently-shaped with respect to one another.

5. The collapsible watercraft assembly of claim 1 wherein said first pontoon half and said second pontoon half are moved along a first axis when moved into said stowed configuration and wherein said at least one first post and said at least one second post overlap along said first axis when said first pontoon half and said second pontoon half are in said stowed configuration.

6. The collapsible watercraft assembly of claim 1 wherein said at least one first post is further defined as a plurality of first posts.

7. The collapsible watercraft assembly of claim 6 wherein said plurality of first posts are aligned along a centered, longitudinal axis of said first pontoon half.

8. The collapsible watercraft assembly of claim 6 wherein at least one of said plurality of first posts extend away from said first bottom surface beyond said first top surface.

9. The collapsible watercraft assembly of claim 8 wherein all of said plurality of first posts extend away from said first bottom surface beyond said first top surface.

10. The collapsible watercraft assembly of claim 1 wherein said at least one first post and said at least one second post prevent said first top surface and said second top surface from contacting one another when said first pontoon half and said second pontoon half are in said stowed configuration whereby a vertical gap is defined between said first top surface and said second top surface when said first pontoon half and said second pontoon half are in said stowed configuration.

11. The collapsible watercraft assembly of claim 10 wherein said frame member fits in said vertical gap between both of said first top surface and said second top surface when said first pontoon half and said second pontoon half are in said stowed configuration.

12. The collapsible watercraft assembly of claim 11 further comprising:

a second frame member, said frame member and said second frame member selectively engageable and disengageble with one another, said frame member and said second frame member engaged with one another when said first pontoon half and said second pontoon half are in said operating configuration, said frame member and said second frame member disengaged with and stackable on top of one another in said vertical gap when said first pontoon half and said second pontoon half are in said stowed configuration.

13. The collapsible watercraft assembly of claim 12 further comprising:

a case having a base and lid pivotally connected to one another, wherein said first pontoon half and said second pontoon half are stackable on top of one another in said stowed configuration and positionable in said case while in said stowed configuration.

14. The collapsible watercraft assembly of claim 1 wherein said frame member further comprises:

a first sleeve portion telescopically engaged with said at least one first post when said first pontoon half and said second pontoon half are in said operating configuration;

a second sleeve portion telescopically engaged with said at least one second post when said first pontoon half and said second pontoon half are in said operating configuration; and a linking portion interconnecting said first sleeve portion and said second sleeve portion in spaced relation to one another, wherein said at least one first post and said at least one second post are at least one of differently-sized or differently-shaped with respect to one another.

15. The collapsible watercraft assembly of claim 14 further comprising:

a railing member having a first shaft portion, a second shaft portion, and a railing portion interconnecting said first shaft portion and said second shaft portion in spaced relation to one another, wherein said first shaft portion is telescopically engageable with said at least one first post when said first pontoon half and said second pontoon half are in said operating configuration and said second shaft portion is telescopically engageable with said at least one second post when said first pontoon half and said second pontoon half are in said operating configuration.

16. The collapsible watercraft assembly of claim 15 wherein said at least one first post encircles said first shaft portion and said first sleeve portion encircles said at least one first post when said first pontoon half and said second pontoon half are in said operating configuration.

17. The collapsible watercraft assembly of claim 16 wherein said at least one second post encircles said second shaft portion and said second sleeve portion encircles said at least one second post when said first pontoon half and said second pontoon half are in said operating configuration.

18. The collapsible watercraft assembly of claim 17 wherein said at least one first post encircles said at least one second post when said first pontoon half and said second pontoon half are in said stowed configuration.

19. The collapsible watercraft assembly of claim 15 wherein a height of said railing member is equal to or less than a height of at least one of said first pontoon half and said second pontoon half.

20. The collapsible watercraft assembly of claim 15 further comprising:

at least one foot rest member telescopically received in said linking portion.

* * * * *